United States Patent [19]

Roberts et al.

[11] 4,313,542

[45] Feb. 2, 1982

[54] SINGLE-SERVING PIE CARTON AND BLANK

[75] Inventors: Harry H. Roberts, Roswell, Ga.; Raymond A. Cote, Taylorville, N.C.

[73] Assignee: Champion International Corporation, Stamford, Conn.

[21] Appl. No.: 161,027

[22] Filed: Jun. 19, 1980

Related U.S. Application Data

[63] Continuation of Ser. No. 57,164, Jul. 13, 1979, abandoned.

[51] Int. Cl.[3] ..... B65D 5/54

[52] U.S. Cl. ..... 206/611; 229/22

[58] Field of Search ..... 229/22; 206/611, 624, 206/625, 629

[56] References Cited

U.S. PATENT DOCUMENTS

| | | | |
|---|---|---|---|
| 2,220,110 | 11/1940 | Layton | 229/22 |
| 2,298,146 | 10/1942 | Mersbach | 229/22 |
| 2,583,915 | 1/1952 | Whitley | 229/22 |
| 2,584,379 | 2/1952 | Chmielewski | 229/22 |
| 2,701,090 | 2/1955 | Buttery | 229/22 |
| 3,142,430 | 7/1964 | Meyers | 229/22 |
| 3,239,129 | 3/1966 | Schilling et al. | 206/611 |
| 3,620,403 | 11/1971 | Rump | 229/22 |
| 3,620,411 | 11/1971 | Rump | 229/22 |
| 3,623,650 | 11/1971 | Watts | 229/22 |
| 3,876,131 | 4/1975 | Tolaas | 229/22 |

*Primary Examiner*—Stephen P. Garbe

*Attorney, Agent, or Firm*—Evelyn M. Sommer

[57] ABSTRACT

Disclosed is a carton especially adapted to package single servings of pie. The carton has a triangular shape due to triangular top and bottom panels. A trapezoidal end wall connects the top and bottom panels at the bases of the respective triangles and slants outwardly from bottom to top. The bottom panel has inner side wall panels attached to it. The inner side wall panels are secured in the vertical upright position by means of corner flaps which are preferably secured to the outer surfaces of the inner side wall panels. The top panel can contain an opening which is preferably covered by a strip of film. The fragile pie crust is better protected by the slanted end wall, and further by the overlapping corner flaps.

5 Claims, 8 Drawing Figures

SINGLE-SERVING PIE CARTON AND BLANK

This is a continuation of application Ser. No. 57,164, filed July 13, 1979, now abandoned.

BACKGROUND OF THE INVENTION

This invention relates to an improved carton for packaging single servings of pie, and more specifically to a carton of this type which is attractive in appearance and provides adequate protection for its contents.

U.S. Pat. No. 3,876,131 and U.S. Re. Pat. No. 29,185, disclose triangularly-shaped cartons useful for packaging triangularly-shaped food products, such as slices of pizza. The cartons were adapted to hold the product during storage and heating. Heating by microwave oven was facilitated by openings which permitted circulation of air through the carton during the heating process, but which could be sealed prior to use. The openings were preferably made in the bottom panel and in the adjoining end wall panel, and were normally covered by a removable strip of film to protect the product from contamination during storage. These disclosures did not identify structural design features necessary to accommodate a single-serving slice of pie of the dessert-type which typically has a thin outer shell of a baked pastry crust and contains a filling of fruit or the like.

Dessert-type pies must be carefully protected from breakage, as well as drying out and contamination. Pies of this type are typically cut into single, wedge-shaped portions. The apex of this wedge is particularly fragile and is easily breakable. Similarly, the area of crust which extends around the base of the wedge is also easily broken. While the prior art has developed wedge-shaped cartons, there is no known paperboard carton adapted to package a dessert-type pie in single-serving, wedge-shaped portions and afford a degree of protection to the pie satisfactory for normal abuse during shipping and handling. Dessert-type pies need special protection if they are to survive shipment and handling so that they remain attractive in appearance when finally served.

SUMMARY OF THE INVENTION

It is an object of the present invention to provide a carton especially adapted for packaging single-serving portions of pie.

It is a more specific object of the present invention to provide a carton especially adapted for packaging single-serving portions of a dessert-type pie which will provide adequate protection to the pie so that it remains appetizingly attractive.

It is yet another and more specific object of the present invention to provide a carton especially adapted for storing single-serving portions of pie and protecting its attractive appearance while permitting viewing of the contents of the carton.

It is yet another and still more specific object of the present invention to provide a carton having an easily-opened, tear-off top for storing a single-serving portion of a dessert-type pie with adequate protection for the pie to maintain its attractive appearance.

These and other objects are accomplished according to the present invention which provides an improved carton for use in containing a wedge-shaped piece of pie and a blank for forming a carton of this type. The carton comprises: a triangular bottom panel haing a base edge and converging side edges; a trapezoidal end wall hingedly connected to the base edge of said bottom panel and extending upwardly therefrom to a top edge, wherein the top edge is longer than said base edge; a triangular top panel hingedly connected to said end wall along said top edge, said top panel being substantially identical in shape to said bottom panel but longer from the apex to said top edge than the distance from the apex to said base edge of said bottom panel, and extending parallel to said bottom panel; inner side wall panels secured to the converging edges of said bottom panel and extending upwardly therefrom; outer side wall panels secured to the converging edges of said top panel and extending downwardly therefrom and outwardly of said inner side wall panels; corner flaps connecting the converging ends of said inner side walls and connecting the ends of said end wall to said inner side walls; and means securing said inner and outer side wall panels in face contact.

BRIEF DESCRIPTION OF THE DRAWINGS

The invention will become better understood from the following detailed description, especially when read in light of the attached drawings, wherein.

DETAILED DESCRIPTION OF THE INVENTION

Figure 1:
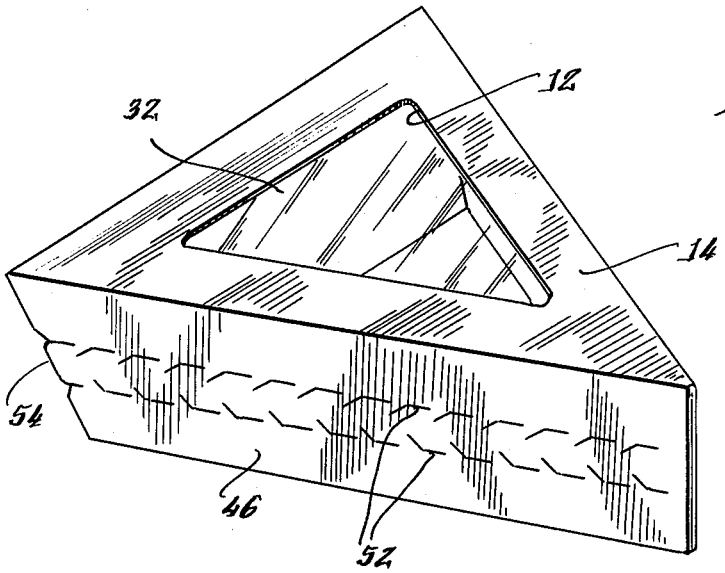
FIG. 1 is a perspective view of a preferred embodiment of a carton according to the present invention.
Figure 5:
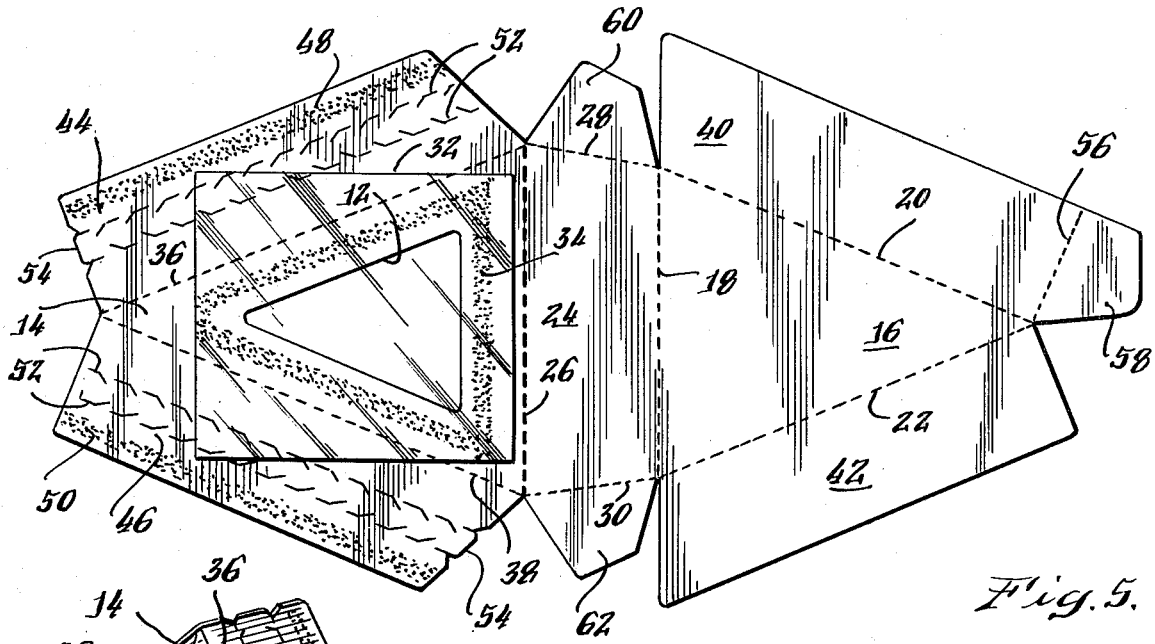
FIG. 5 is a diagrammatic view of a carton blank from which a carton as shown in FIG. 1 can be formed, the blank being viewed from what will be the inside surface of the carton.
Figure 8:
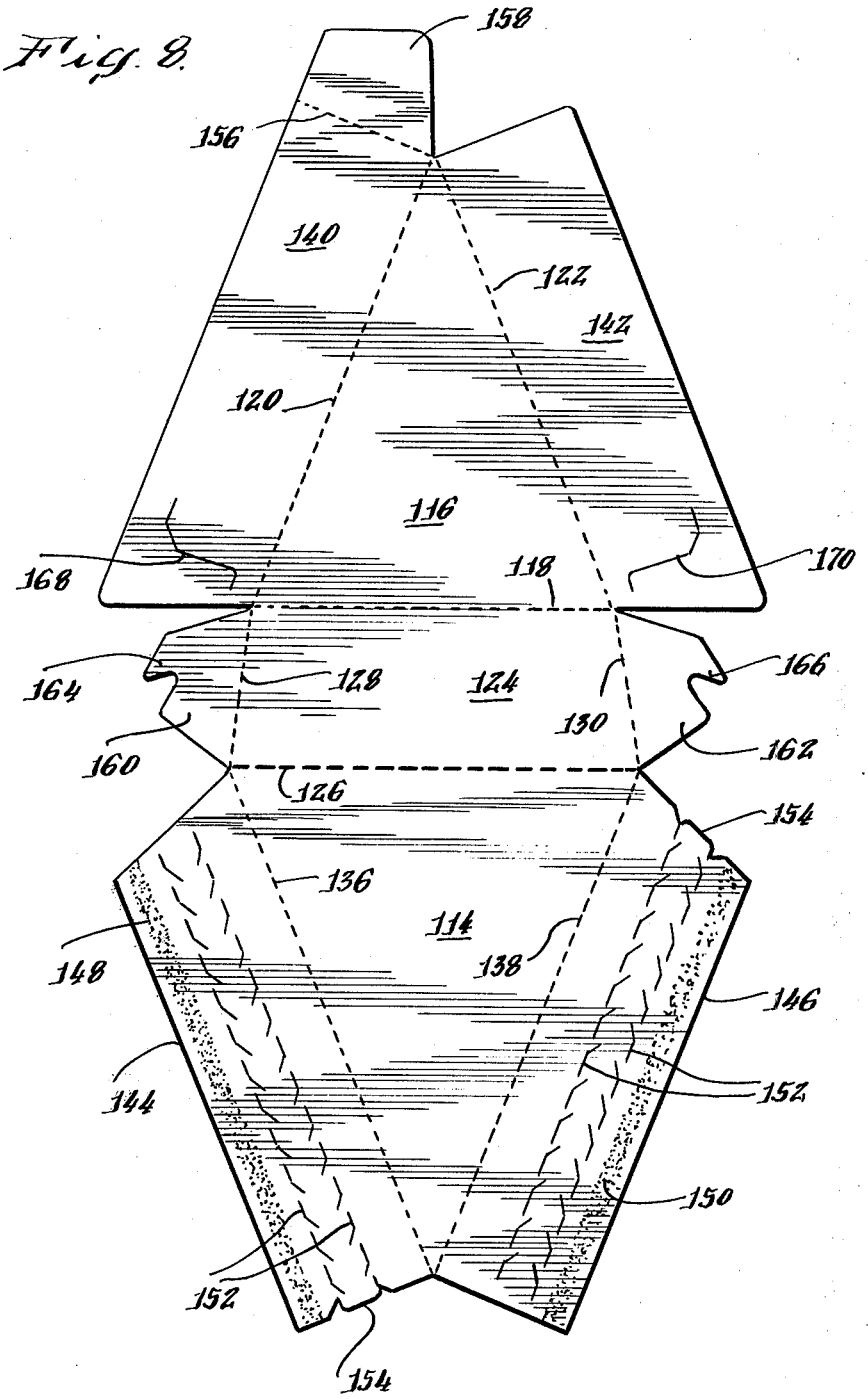
FIG. 8 is a diagrammatic view of a carton blank for forming an alternative form of carton, also viewed from what will be the inside surface of the carton.

The carton provided by the present invention is generally of triangular shape and has a suitable design for providing an adequate degree of protection to a piece of dessert pie placed therein to protect it from damage during shipment and handling. The preferred form of the carton generally designated 10 in FIG. 1 will have a window 12 for viewing the contents of the carton and will have an easily removable top 14. The blank for forming the carton shown in FIG. 1 is shown in FIG. 5. An alternative form of blank for forming a carton having a closed top panel is shown in FIG. 8.

Figure 3:
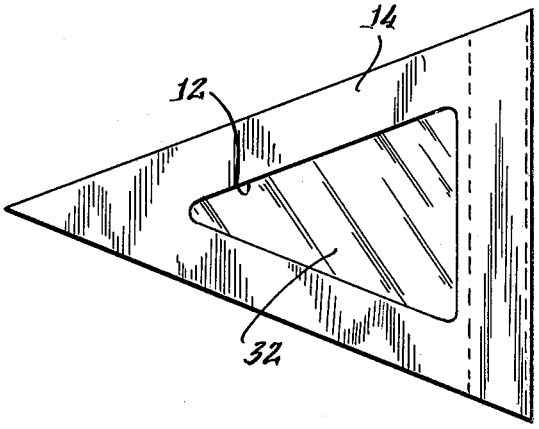
FIG. 3 is a top plan view of the carton as shown in FIG. 1.
Figure 2:
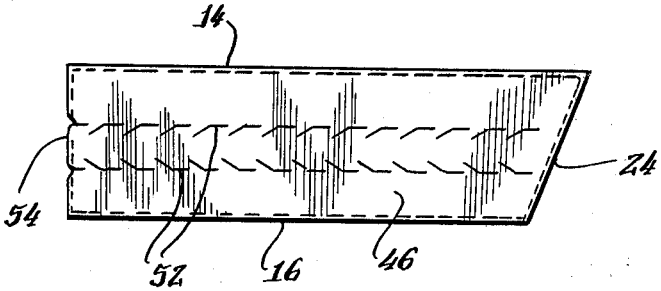
FIG. 2 is a side elevational view of the carton shown in FIG. 1.
Figure 4:
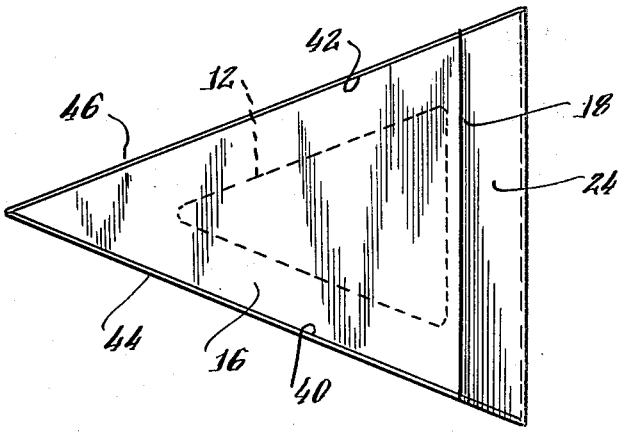
FIG. 4 is a bottom plan view of the carton as shown in FIG. 1.
Figure 6:
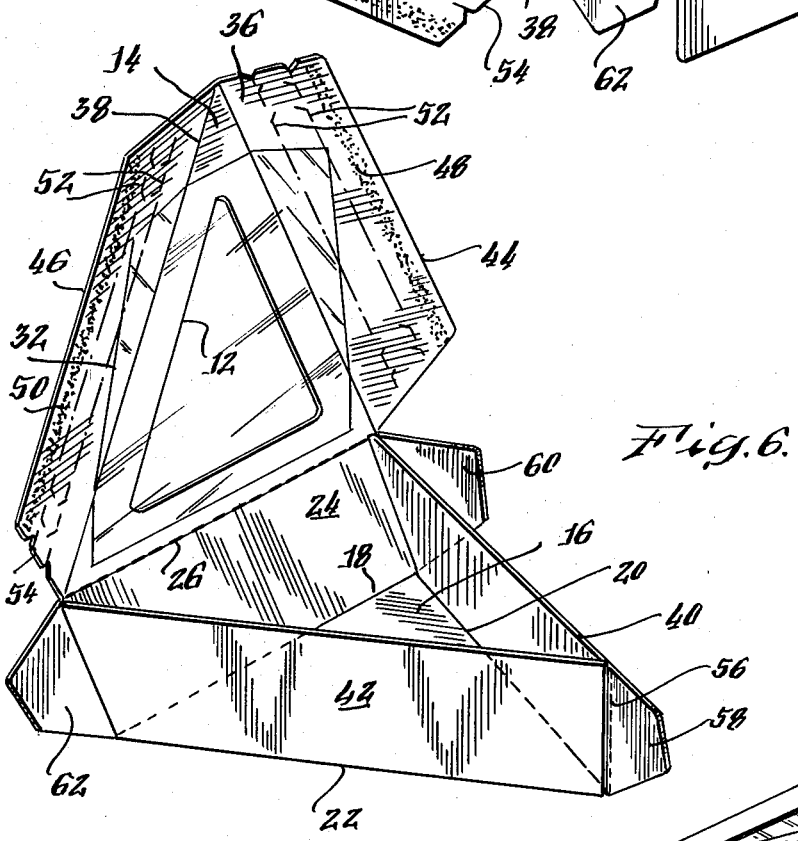
FIG. 6 is a perspective view showing an initial stage of assembly of the carton as shown in FIG. 1.
Figure 7:
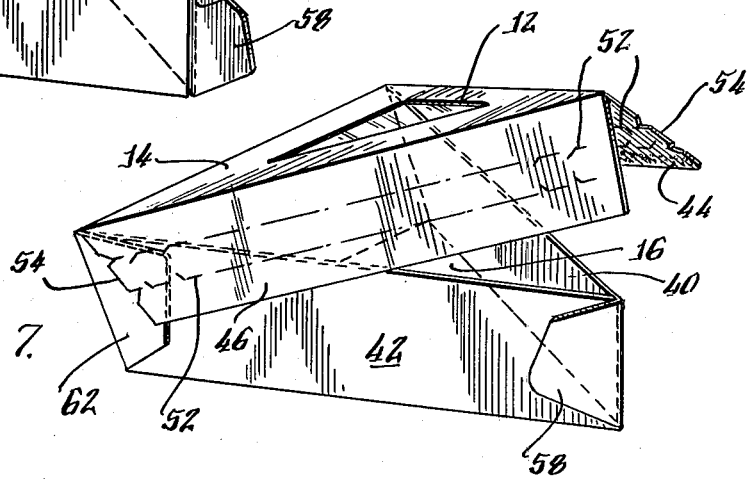
FIG. 7 shows a final stage of assembly of the carton as shown in FIG. 1.

Reference is now made to FIG. 5 which shows a blank for forming a carton according to the present invention as shown in FIG. 1. This carton is shown in FIGS. 2 through 4 when viewed from various directions. Also shown are successive stages of construction in FIGS. 6 and 7. The blank shown in FIG. 5 is viewed from what will be the inside of the carton. The blank is shown to have a triangular bottom panel 16 having a base edge 18 and converging side edges 20 and 22. A trapezoidal end wall 24 is hingedly connected to the base edge 18 of the bottom panel 16. The end wall 24 has a top edge 26 which is longer than the base edge 18. The end wall 24 also has side edges 28 and 30.

Hingedly connected to the top edge 26 of the end wall panel 24 is top panel 14 having window opening 12 therein. The window 12 can be covered with a suitable film material shown as 32 which is preferably applied in strip form and secured to the top panel 14 by means of glue applied as indicated at 34. The film 32 can be any of those materials known to be suitable. The top panel 14 is substantially identical in shape to the bottom panel 16 but is longer from the apex of the triangle where side edges 36 and 38 converge, to the top edge 26 than the distance from the apex formed by bottom panel side edges 20 and 22 to the base edge 18 of the bottom panel 16.

By dimensioning the top panel 14, the bottom panel 16 and the end wall panel 24 as described, the end wall panel 24 will slant outwardly from base edge 18 up toward top edge 26 as can be clearly seen in FIG. 2. This outwardly slanting end wall panel 24 closely conforms to the shape of a pie crust and thereby increases the support for the crust and decreases the likelihood of damage to this portion of a pie.

Inner side wall panels 40 and 42 are connected to bottom panel 16 along side edges 20 and 22, respectively. It can be seen in FIG. 6, for example, that the side wall panels 40 and 42 are folded upwardly about fold lines at side edges 20 and 22 to form vertically upright side wall panels. In the final carton, these side walls 40 and 42 are on the interior of the carton and are overlapped and sealed to outer side wall panels 44 and 46. It can also be seen in FIG. 6 or FIG. 7 that outer side wall panels 44 and 46 are bendably attached to side wall panel 14 about fold lines at the side edges 36 and 38. It is preferable to secure the outer side wall panels 44 and 46 to the inner side wall panels 40 and 42 by suitable means such as glue positioned at areas 48 and 50. Alternatively, the inner and outer side wall panels can be secured by a "Lock-Heat" seal process wherein the paperstock from which the blank is formed is provided with a coating of polyethylene thereon and a jet of superheated air is directed onto the inner and outer side wall panels during the erection process in order to melt the polyethylene coating on such panels to produce a bond therebetween.

It can be seen that both side wall panels 44 and 46 have intermitted cut lines 52 extending along their lengths parallel to side edges 36 and 38. By providing a pair of intermitted cut lines 52 in this or similar manner, which terminate in tabs shown as 54, tear strips are provided for easily opening the carton. By pulling on tabs 54, the entire strip of material between the intermittent cut lines 52 is removed and the top panel 14 can be lifted upward. By providing an intermittent score line at top edge 26, it is possible to remove the entire top of the container very simply.

In some situations, it is desired to warm the pie in a microwave oven. This may be to defrost a totally frozen pie or to simply heat an ambient temperature or conventionally-refrigerated pie to bring it to a moderately warmed condition. The carton of the present invention is particularly well suited for heating in this manner without opening the carton. If it is desired, however, the film strip 32 can be removed from the opening 12 in the top panel 14 to permit escape of moisture generated during more prolonged heating in a microwave oven. Further, the entire lid can be removed to serve the same purpose.

Attached to edge 56 of inner side wall panel 40, is a corner flap 58. Corner flap 58 is preferably attached to the outside of inner side wall panel 42 either by gluing or the Lock-Heat process previously described. By securing corner flap 58 to the outside of inner wall member 42, a sturdier joint is formed between the converging ends of inner side wall members 40 and 42. This fold around flap 58 provides improved protection to the pointed edge of the individual serving of pie positioned within the container. The flap 58 may also be attached by either method mentioned above to the inner surface of inner side wall panel 42. Alternately, the flap 58 may simply fold into overlapping relationship to inner side wall panel 42, without attachment thereto, in which case the flap 58 is held in place by outer side wall panel 46 when the carton is closed.

Corner flaps 60 and 62 are provided along edges 28 and 30 of the end wall panel 24. As shown in detail in FIGS. 6 and 7, these corner flaps 60 and 62 are bent into contact with the outside surface of inner side wall panels 40 and 42, respectively. As with the corner flap 58, corner flaps 60 and 62 can be secured by means of gluing or the like.

As pointed out above, outer side wall panels 44 and 46 are secured to the outer surfaces of inner side wall panels 40 and 42 by suitable means. As discussed above, this means may comprise areas of glue applied at areas 58 and 50. By positioning the glue areas 48 and 50 in this manner, they are below the tear strips defined by tabs 54 and paired intermittent cut lines 52 which appear on both outer side wall panels 44 and 46.

The carton, according to the present invention, will preferably be made of a paperboard material and most preferably will contain a layer of a plastic or wax material adhered thereto to provide a moisture barrier. Virtually all paperboard materials have a grain which is caused by the method of manufacturing. It is preferred to have this grain run along the longitudinal axis of the blank. Thus, the grain will run parallel to a line which passes through the apexes of the top and bottom triangular panels 14 and 16 where their respective side wall edges converge. It is preferred to have the grain run in this direction because the tear strips defined by tab 54 and intermittent cut lines 52 will more easily be removed by pulling where they run substantially parallel to the grain, moreover such grain direction provides the end panel with greater stacking strength.

It will be seen from the figures that the inner and outside wall members are positioned perpendicularly to the plane of the top panel 14 and the bottom panel 16 which are essentially parallel to each other. Forming the carton in this manner provides a desirable degree of strength and facilitates sealing of the inner surface of the outer side wall panels to the outer surface of the inner side wall panels.

Referring to the alternative embodiment for the blank as shown in FIG. 8, the last two digits of like parts to those shown in the other figures are the same as those parts, while all parts in this figure are given numbers greater than 100. In FIG. 8, the top wall panel 114 is constructed without a window for viewing the contents of the package. Attached to end wall panel 124 at end wall edges 128 and 130 are corner flaps 160 and 162. These corner flaps have male locking tabs 164 and 166 at the ends thereof which mate with female slots 168 and 170 in inner side wall numbers 140 and 142, respectively.

The above description has been for the purpose of teaching those skilled in the art how to make and use the present invention and has not been for the purpose of reciting all those obvious modifications and variations of it which will become apparent upon a reading. It is intended, however, that all such obvious modifications and variations be included within the scope of the present invention which is defined by the following claims.

What is claimed is:

1. A blank for forming a wedge-shaped carton having a slanted end wall, said carton comprising:

a triangular bottom panel having a base edge and two side edges;

a trapezoidal end wall having top, bottom and side edges, with said bottom edge of said end wall and said base edge of said bottom panel being hingedly connected and of equal length, and with corner flaps being respectively hingedly connected to the side edges of said trapezoidal end wall;

a triangular top panel having a base edge and two side edges, with the length of the base edge of said top panel being greater than the length of the base edge of said bottom panel, and with the length of said top panel measured along an imaginary line extending perpendicularly from the associated base edge to the opposed apex thereof being greater than the length of said bottom panel measured along an imaginary line extending perpendicularly from the associated base edge to the opposed apex thereof, said base edge of said top panel being hingedly connected and of equal length to the top edge of said trapezoidal end wall;

a pair of side wall panels extending from and hingedly connected to the associated side edges of said triangular top and bottom panels, with each side wall panel of one pair of said side wall panels including a pair of spaced, intermittent cut lines extending along the length thereof and defining a tear strip to permit easy opening of the erected carton which is of wedge-shaped configuration having a slanted trapezoidal end wall and which is useful for containing a wedge-shaped piece of pie having a slanted crust portion, with the carton conforming to the shape of said pie piece and with said sloping trapezoidal end wall functioning to provide increased protection and support to the slanted crust portion thereof.

2. A blank according to claim 1 wherein said blank is formed of a one-piece foldable cardboard material.

3. A blank according to claim 1 wherein said triangular top panel includes a window opening therein.

4. A blank according to claim 1 wherein a fold around flap is hingedly connected to the edge of one side wall panel extending from said bottom panel, said fold around flap being disposed adjacent the apex of said triangular bottom panel.

5. A blank according to claim 1 wherein said corner flaps include male locking tabs, and each said side wall panel extending from the bottom panel includes a cooperating locking slot for connecting the ends of said trapezoidal end wall with said side wall panels extending from the bottom panel when the blank is erected into a wedge shaped carton.

* * * * *